US007255425B2

(12) United States Patent
Lai et al.

(10) Patent No.: US 7,255,425 B2
(45) Date of Patent: Aug. 14, 2007

(54) INK-CHANNEL WAFER INTEGRATED WITH CMOS WAFER FOR INKJET PRINTHEAD AND FABRICATION METHOD THEREOF

(75) Inventors: Tsung-Mu Lai, Hsinchu Hsien (TW); Hua-Shu Wu, Hsinchu (TW); Ming-Chih Chang, Taipei (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 291 days.

(21) Appl. No.: 11/001,007

(22) Filed: Dec. 2, 2004

(65) Prior Publication Data

US 2006/0119662 A1 Jun. 8, 2006

(51) Int. Cl.
*B41J 2/05* (2006.01)

(52) U.S. Cl. ..... 347/56; 347/65

(58) Field of Classification Search ..... 347/20, 347/44, 47, 54, 56, 58–59, 61–65, 67, 84–86
See application file for complete search history.

(56) References Cited

U.S. PATENT DOCUMENTS

| | | | | |
|---|---|---|---|---|
| 4,894,664 A | | 1/1990 | Tsung | 347/63 |
| 5,198,834 A | | 3/1993 | Childers | 347/65 |
| 5,738,799 A | | 4/1998 | Hawkins | 216/27 |
| 6,019,457 A | * | 2/2000 | Silverbrook | 347/65 |

* cited by examiner

*Primary Examiner*—Juanita D. Stephens
(74) *Attorney, Agent, or Firm*—Birch, Stewart, Kolasch & Birch, LLP

(57) ABSTRACT

An ink-ejection unit of an inkjet printhead integrates an ink-channel wafer onto a CMOS wafer with a heating element fabricated therein. A nozzle film with a nozzle orifice is formed on the backside of the CMOS wafer, which allows two-dimensional ink ejecting from the backside of the CMOS wafer.

21 Claims, 11 Drawing Sheets

INK-CHANNEL WAFER INTEGRATED WITH CMOS WAFER FOR INKJET PRINTHEAD AND FABRICATION METHOD THEREOF

FIELD OF THE INVENTION

The present invention relates to printing systems, and particularly to a page-width inkjet printhead with an ink-channel wafer bonded to a CMOS (Complementary Metal-Oxide Semiconductor) wafer.

BACKGROUND OF THE INVENTION

Inkjet printheads eject small ink droplets for printing at a desired position on a paper and print out images having predetermined colors. The most widespread technologies are based on a thermal bubble type or a piezoelectric type according to its primary working principle. The thermal bubble type employs a heater to vaporize ink droplets, and uses high-pressure bubbles to drive the ink droplets through the nozzle orifices, but has limitations in heat dispatch and its using longevity. The piezoelectric inkjet printhead has been commercialized into a bend mode and a push mode according to the deformation mechanism of the piezoelectric body. The piezoelectric type employs a forced voltage to deform a piezoelectric ceramic body, and uses flexure displacement of the piezoelectric ceramic body to change the volume of a pressure-generating chamber, thus the chamber expels an ink droplet. The piezoelectric type has superior durability and high-speed print performance, but has limitations in hybrid-system field applications and difficulties in narrowing the nozzle pitch.

The thermal and piezoelectric inkjet printheads suffer from excessive heat increment and energy consumption, and are not suitable for use in a page-width configuration. As used herein, the term "page-width" refers to printheads of a minimum length of about four inches. One major difficulty in realizing page-width inkjet printheads is that nozzles have to be spaced closely together, and the other difficulty is that the drivers providing power to the heaters and the electronics controlling each nozzle must be integrated with each nozzle. One way of meeting these challenges is to build the printheads on silicon wafers utilizing VLSI technology and to integrate complementary metal-oxide-silicon (CMOS) circuits on the same silicon substrate with the nozzles.

In order to achieve high-density nozzles and high-efficient heaters, a page-width thermal inkjet printhead with self-cooling and cavitation-immune nozzles is taught in U.S. Pat. No. 4,894,664. FIG. 1 shows a cross-section of the conventional thermal ink jet printhead. On a substrate 10, ink in an ink well 12 is evaporated by a resistor layer 14 to migrate to a nozzle area 16. A nozzle plate 18 directs the gaseous ink as it is expelled from the nozzle area 16 by pressure from the accumulated ink. A thermal barrier layer 24 prevents heat from flowing to a nickel cantilever beams 20 and a nickel substrate 22. A patterned conducting layer 26 shorts out the resistor layer 14 except on the cantilever beams 20. A protective layer 28 prevents electrical shorts during the nickel-plating process to form the nozzle plate 18. A conducting layer 29 is deposited during the manufacturing process to provide a surface upon which the nozzle plate 18 can be constructed.

An ink channel plate is a further main section of the thermal inkjet printhead. U.S. Pat. No. 5,738,799 discloses an ink jet fabrication technique that enables capillary channels for liquid ink to be formed with square or rectangular cross-sections. Particularly, a sacrificial layer of polyimide and a permanent material are applied over the main surface of a silicon chip to form open ink channels. U.S. Pat. No. 5,198,834 discloses an inkjet printer that utilizes a barrier wall located between a substrate and an orifice plate, in which ink flows through the ink channels defined in the barrier wall. The barrier wall is fabricated in two layers from cured, photo-imaged resist materials. One layer is a solder-mask material, and the other is a photolithographic resist material. The two layers together resist chemical attack by the ink and separation of the orifice plate from the printhead.

For a page-width thermal inkjet printhead, however, when the above-described ink channel fabrications using sacrificial polymer/photoresist materials are integrated with the CMOS wafer, the printhead suffers from a wafer bow effect and a fragile chamber wall, resulting in difficulties in the process being employed. Accordingly, a non-polymer ink channel and an IC compatible process of forming high nozzle density inkjet printhead with on-chip driving electronics for improved printing quality and simplified process, are called for.

SUMMARY OF THE INVENTION

It is an object of the present invention to provide an ink-ejection unit with a wafer-based ink channel structure through wafer-to-wafer bonding technologies.

It is another object of the present invention to provide a page-width inkjet printhead integrating an ink-channel wafer with a CMOS wafer, which allows two-dimensional ink ejection from the backside of the CMOS wafer.

It is another object of the present invention to provide a fabrication method of an inkjet printhead to overcome the problems of the prior art through the use of a polymer-based ink channel structure.

To achieve the above objectives, the present invention provides an ink-ejection unit of an inkjet printhead. A first substrate comprises a first side and a second side opposite to the first side. A MOS integrated circuit and a heating element are formed overlying the first side of the first substrate. A nozzle film with a nozzle orifice is formed overlying the second side of the first substrate. A second substrate with a trench is bonded to the first side of the first substrate, in which the trench is in a space surrounded by a bonding area between the first substrate and the second substrate to function as an ink channel structure. The second substrate has a thermal expansion coefficient matching that of the first substrate. For example, the first substrate may be a semiconductor silicon substrate, and the second substrate may be a silicon wafer.

To achieve the above objectives, the present invention provides a fabrication method of an ink-ejection unit of a printing system. A first substrate is provided with a first side and a second side opposite to the first side, in which a MOS integrated circuit is formed overlying the first side. At least one dielectric layer is formed overlying the first side of the first substrate. Also, an ink hole is formed to pass through the at least one dielectric layer and a portion of the first substrate, thus a predetermined thickness of the first substrate remains underlying the ink hole. The ink hole is then filled with a sacrificial layer. A heating element is formed overlying the dielectric layer around the ink hole. A second substrate with a trench is bonded to the first side of the first substrate, thus the trench in a space surrounded by a bonding area between the first substrate and the second substrate functions as an ink channel structure. After thinning the first substrate and the second substrate, the predetermined thickness of the first substrate underlying the ink hole is removed to expose the sacrificial layer. A nozzle film with a nozzle orifice is formed overlying the second side of the first substrate. The sacrificial layer is then removed from the ink hole to complete the ink-ejection unit.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description and the accompanying drawings, which are given by way of illustration only, and thus are not limitative of the present invention, and wherein.

DESCRIPTION OF THE PREFERRED EMBODIMENTS

Figure 1:
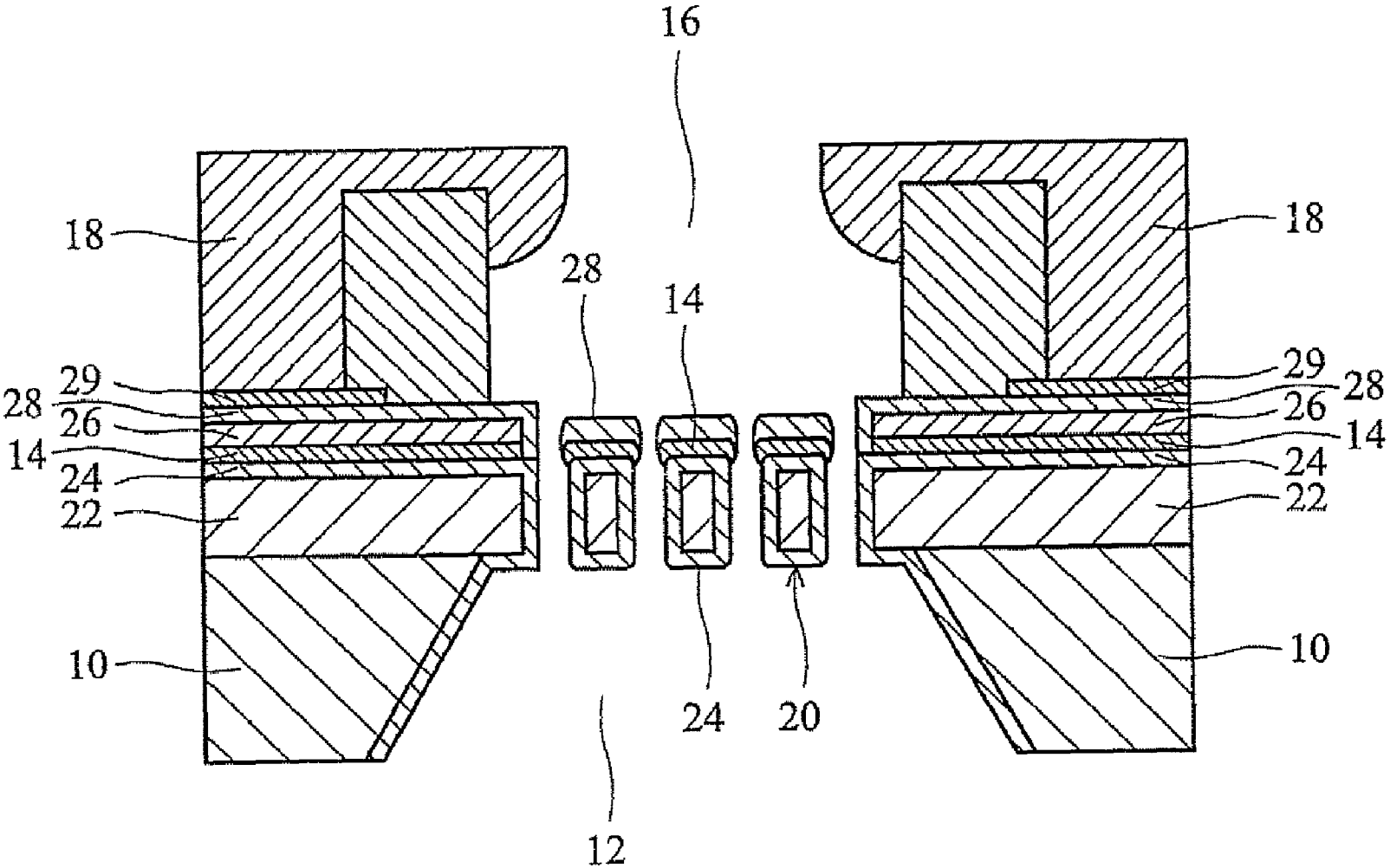
FIG. 1 ( RELATED ART )
FIG. 1 is a cross-section of a conventional thermal inkjet printhead.

The present invention provides an ink-ejection unit with a wafer-based ink channel structure, which is potentially suited to a wide range of printing systems. The present invention employs wafer-to-wafer bonding technologies to construct an alternative form of an inkjet printing device, which overcomes the aforementioned problems of the prior art through the use of polymer-based ink channel structure. The inkjet printhead may be formed utilizing standard VLSI/ULSI processing, and may include integrated drive electronics on a semiconductor substrate, a CMOS type for example. The ink-channel wafer incorporating with wafer bonding technologies of the present invention may be applied to a thermal-bubble type printhead or a piezoelectric type printhead.

As will be appreciated by persons skilled in the art from discussion herein, the present invention has wide applicability to many manufacturers, factories and industries. In the context of this disclosure, the term "semiconductor substrate" is defined to mean any construction comprising semiconductor material, including, but not limited to, bulk semiconductor materials such as a semiconductor wafer and semiconductor material layers. The term "substrate" refers to any supporting structures, including, but not limited to, the semiconductor substrate described above.

Hereinafter, reference will now be made in detail to the present preferred embodiments of the invention, examples of which are illustrated in the accompanying drawings. Wherever possible, the same reference numbers are used in the drawings and the description to refer to the same or like parts. In the drawings, the shape and thickness of an embodiment may be exaggerated for clarity and convenience. This description will be directed in particular to elements forming part of, or cooperating more directly with, apparatus in accordance with the present invention. It is to be understood that elements not specifically shown or described may take various forms well known to those skilled in the art. Further, when a layer is referred to as being on another layer or "on" a substrate, it may be directly on the other layer or on the substrate, or intervening layers may also be presented.

In an exemplary implantation of a thermal inkjet printhead according to the present invention, MOS integrated circuits are formed on a silicon substrate with heating elements and nozzle orifices, and an ink-channel substrate is bonded to the silicon substrate, thus a more compact printhead can be manufactured by a simplified and IC compatible process compared to the prior art. Hereinafter, a manufacturing method for an ink-ejection unit of a thermal inkjet printhead according to an embodiment of the present invention will be described.

FIGS. 2A to 2I are cross-sectional diagrams illustrating a fabrication process of an ink-ejection unit according to an embodiment of the present invention.

Figure 2A:
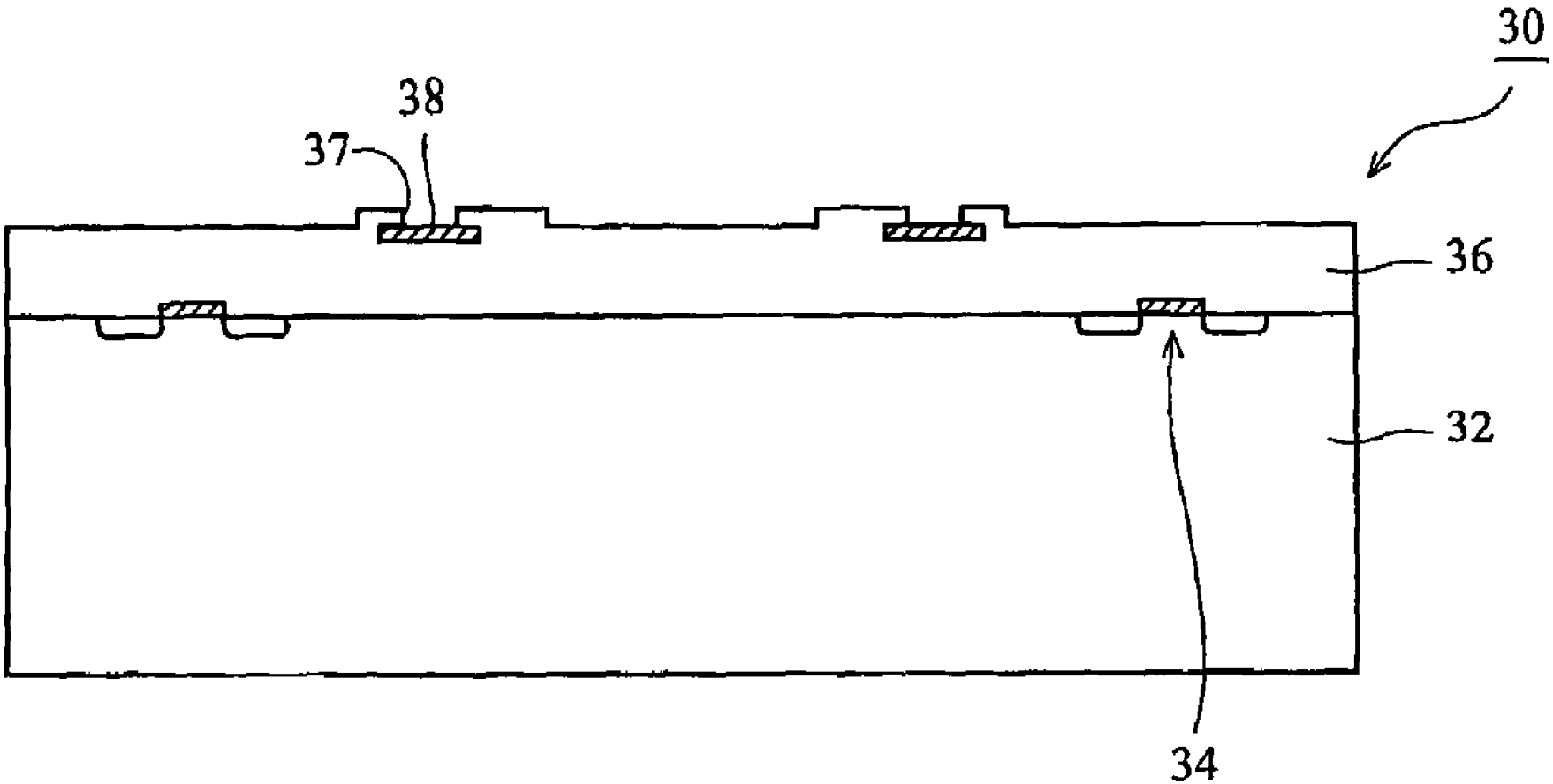
FIGS. 2A to 2I are cross-sectional diagrams illustrating a fabrication process of an ink-ejection unit according to an embodiment of the present invention.

Referring to FIG. 2A, a provided wafer 30 comprises circuitries fabricated on a semiconductor substrate 32. The semiconductor substrate 32 may be a silicon substrate with or without an epitaxial layer. Alternatively, the semiconductor substrate 32 may be a silicon-on-insulator substrate containing a buried insulator layer. It is understood that the type of the semiconductor substrate 32 is a design choice dependent on the fabrication process being employed. In circuitry fabrication, a CMOS process for fabricating drive transistors, data distribution and timing circuits, may be a standard mixed signal process incorporating diffusion regions, polysilicon layers and multi-levels of metal layers interconnected with vias. For example, transistors 34 may be formed in the silicon substrate 32 through conventional steps of selectively depositing various materials to form these transistors as are well known to those skilled in the art. In the drawings, CMOS active components and interconnects are omitted for clarity. Supported on the silicon substrate 32 may have a series of dielectric layers 36 that have one or more of polysilicon layers and metal layers formed therein in accordance with desired patterns. The dielectric layer 36 may be silicon oxide, silicon nitride, silicon oxynitride, low-k dielectric materials, high-k dielectric materials, or combinations thereof. Vias (not shown) are provided between the dielectric layers 36 as needed, and openings 37 are pre-provided on bond pads 38 for allowing access to metal layers. It is understood that the CMOS circuit has interconnections to drive heating elements that will be fabricated thereon and described in detail below.

Figure 2B:
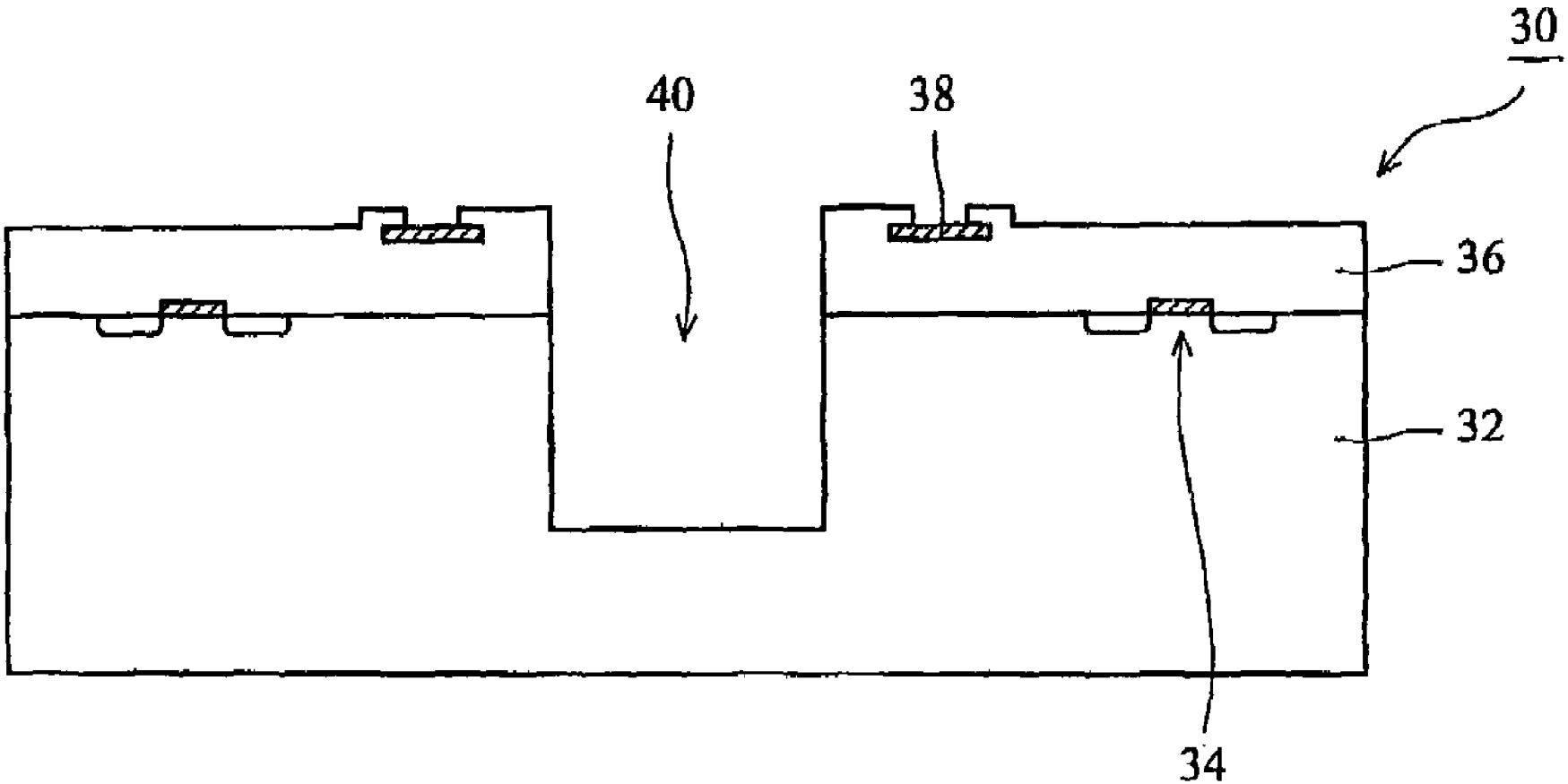

In FIG. 2B, advances in lithography and masking techniques and dry etch processes, such as RIE (Reactive Ion Etching) and other plasma etching processes, allow production of an ink hole 40 that passes through the dielectric layer 36 to reach a predetermined depth of the semiconductor substrate 32. The dry etch process is timed for a depth of the semiconductor substrate 32 approximately 500~900 micrometers, thus a remaining thickness of the semiconductor substrate 32 underlying the ink hole 40 is from about 50 microns to about 200 micrometers. It is understood that the arrangement, shape and size of the ink hole 40 are design choices dependent on product requirements and fabrication limitations.

Figure 2C:
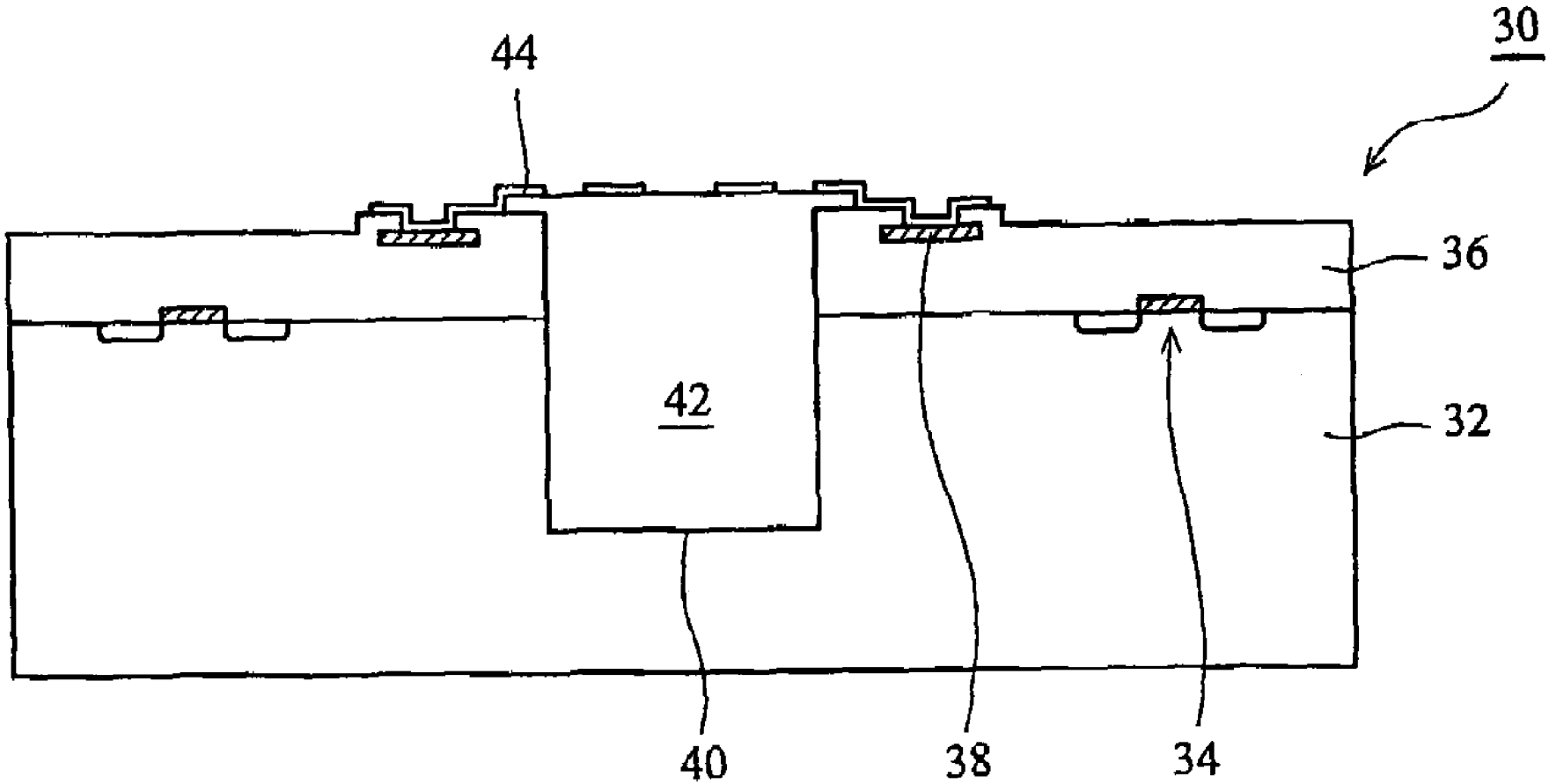

In FIG. 2C, a sacrificial layer 42 is patterned on the semiconductor substrate 32 to temporarily fill the ink hole 40. Deposition techniques such as spin-on, CVD (chemical vapor deposition), LPCVD (low-pressure chemical vapor deposition), APCVD (atmospheric-pressure chemical vapor deposition), PECVD (plasma-enhanced chemical vapor deposition) and future-developed deposition procedures may be used to deposit the sacrificial layer 42, which may include, for example polymer, photoresist, photosensitive materials, silicon oxide, silicon nitride, silicon oxynitride, low-k dielectric materials, high-k dielectric materials, suitable organic materials and suitable inorganic materials. Chemical mechanical polishing (CMP) or etch back processes may be then used to planarize the sacrificial layer 42. Further, developing or etching technologies may be optionally used to remove the sacrificial layer 42 from the surfaces of the dielectric layer 36 and the metal pad 38 dependent on the material characteristics of the sacrificial layer 42. For example, a developing procedure uses a developer solution as an etchant for the polymer/photoresist option.

Next, a heating element 44 is fabricated on the dielectric layer 36 to suspend and surround the ink hole 40 by a sacrificial-material casing process for example, resulting in heater cantilever on the IC wafer. The heating element 44 is also electrically connected to the bond pad 38, thus the CMOS integrated circuit is as a driving circuit for the heating element 44. The heating element 44 may have a ring shape and formed of a resistance-heating material, for example impurity-doped polysilicon or tantalum-aluminum alloy. The arrangement and construction profile of the heating element 44 are design choices dependent on product requirements and fabrication limitations.

Figure 2D:
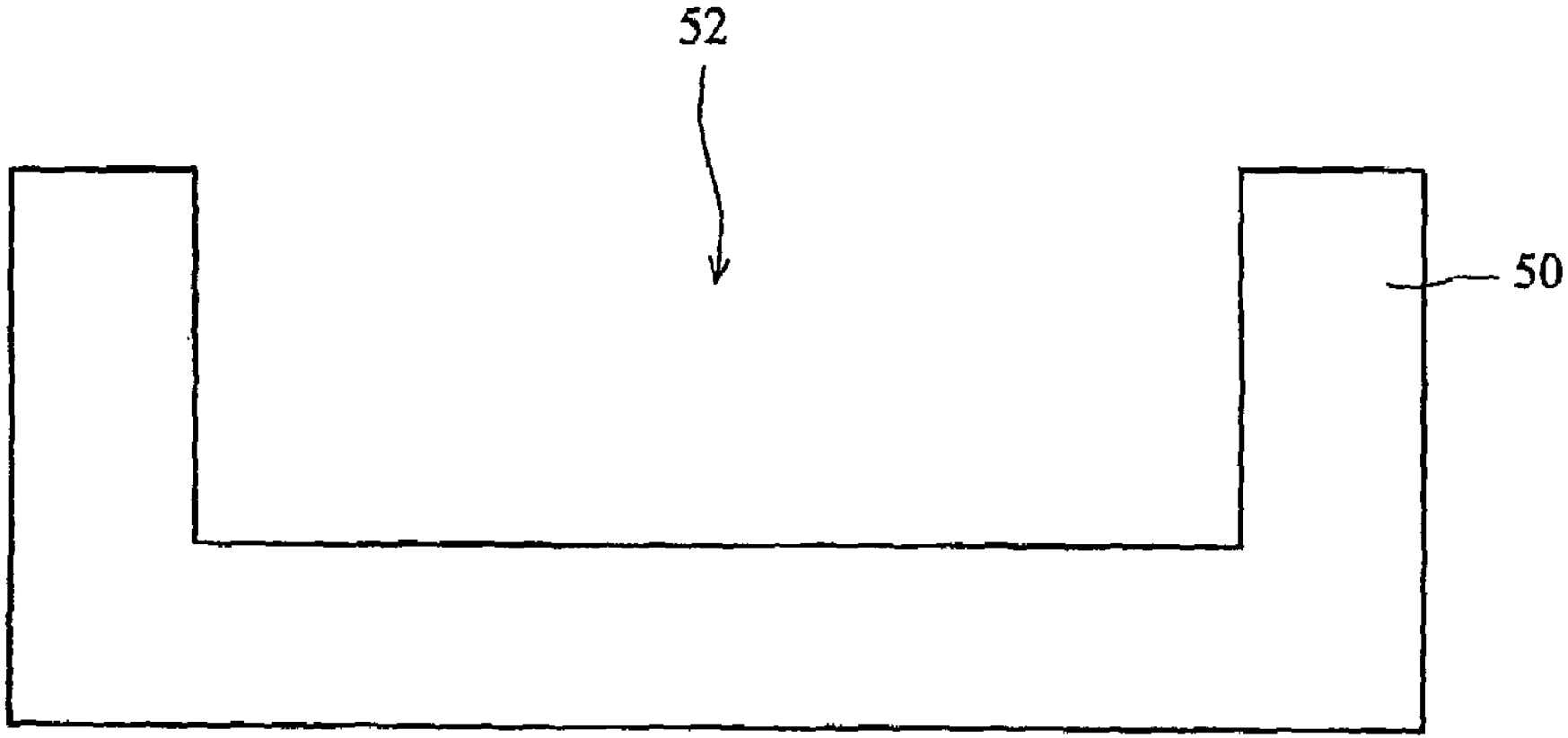

In FIG. 2D, a substrate 50 is provided with a trench 52 in accordance with an ink-channel pattern. For example, lithography and masking techniques and dry etch processes, including, but not limited to, RIE and plasma etching processes, may be performed on a bulk material to define an ink-channel pattern. Otherwise, a sand blasting system may be performed on a bulk material to form a slotted substrate. The trench 52 has about 50~200 micrometers in depth, and about 50~1000 micrometers in width. It is understood that the arrangement, profile and size of the trench 50 are design choices dependent on product requirements and processes being employed. The substrate 50 may be a bulk material with a thermal expansion coefficient matching that of the semiconductor substrate 32. For example, the substrate 50 may include silicon wafer, ceramic, glass, semiconductor materials and silicon-based materials. A silicon wafer is preferably selected because silicon wafers are widely used in manufacturing semiconductor devices and may be used without change, thereby facilitating mass production. In an exemplary implementation of the present invention, the substrate 50 with the trench 52 is defined to mean an ink-channel wafer 50 hereinafter.

Figure 2E:
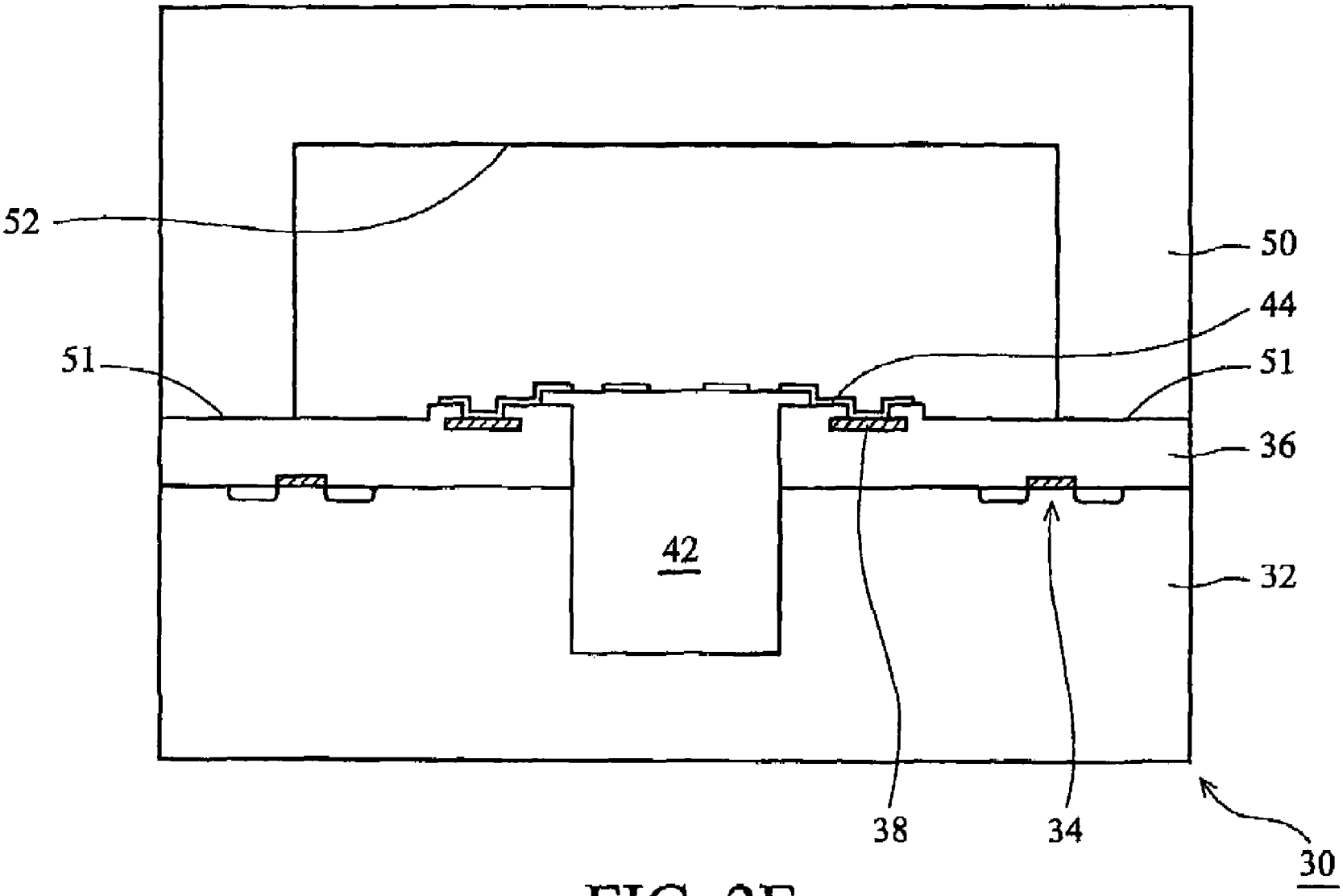
Figure 2F:
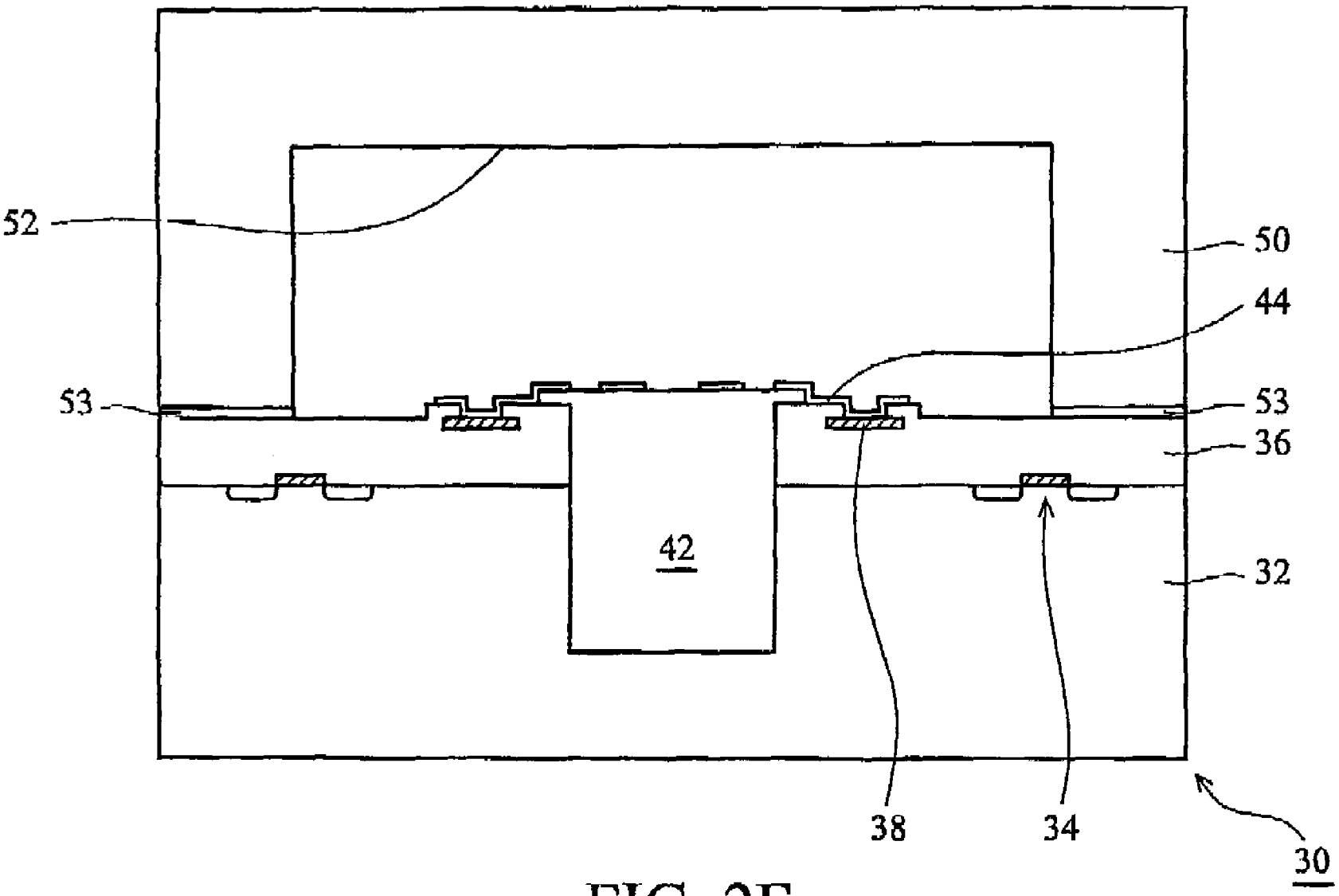

In FIG. 2E, one key feature of the present invention is to bond the ink-channel wafer 50 downward to the dielectric layer 36 of the provided wafer 30 with a hermetic seal, resulting in a dual-wafer bonding composite substrate. The trench 52, in a space surrounded by a bonding area 51 between the two wafers 30 and 50, functions as an ink channel structure that allows an ink delivery path from an ink reservoir to a nozzle orifice through the heating element 44 of the ink-ejection unit. Several wafer bonding techniques may be used to bond the two wafers 30 and 50 together, including, but not limited to, anodic bonding, silicon direct bonding and intermediate layer bonding. The silicon direct bonding also known as fusion bonding, may use a pressure and a temperature treatment to create a sufficiently strong bond. Existing materials within either the ink-channel wafer 50 or the provided wafer 30 may limit the bonding temperature. Otherwise, as shown in FIG. 2F, the intermediate layer bonding may use an adhesion layer 53, such as a low-temperature oxide layer or a glue film to achieve strong, high quality wafer bonding performance on the bonding area 51 between the two wafers 30 and 50.

Figure 2G:
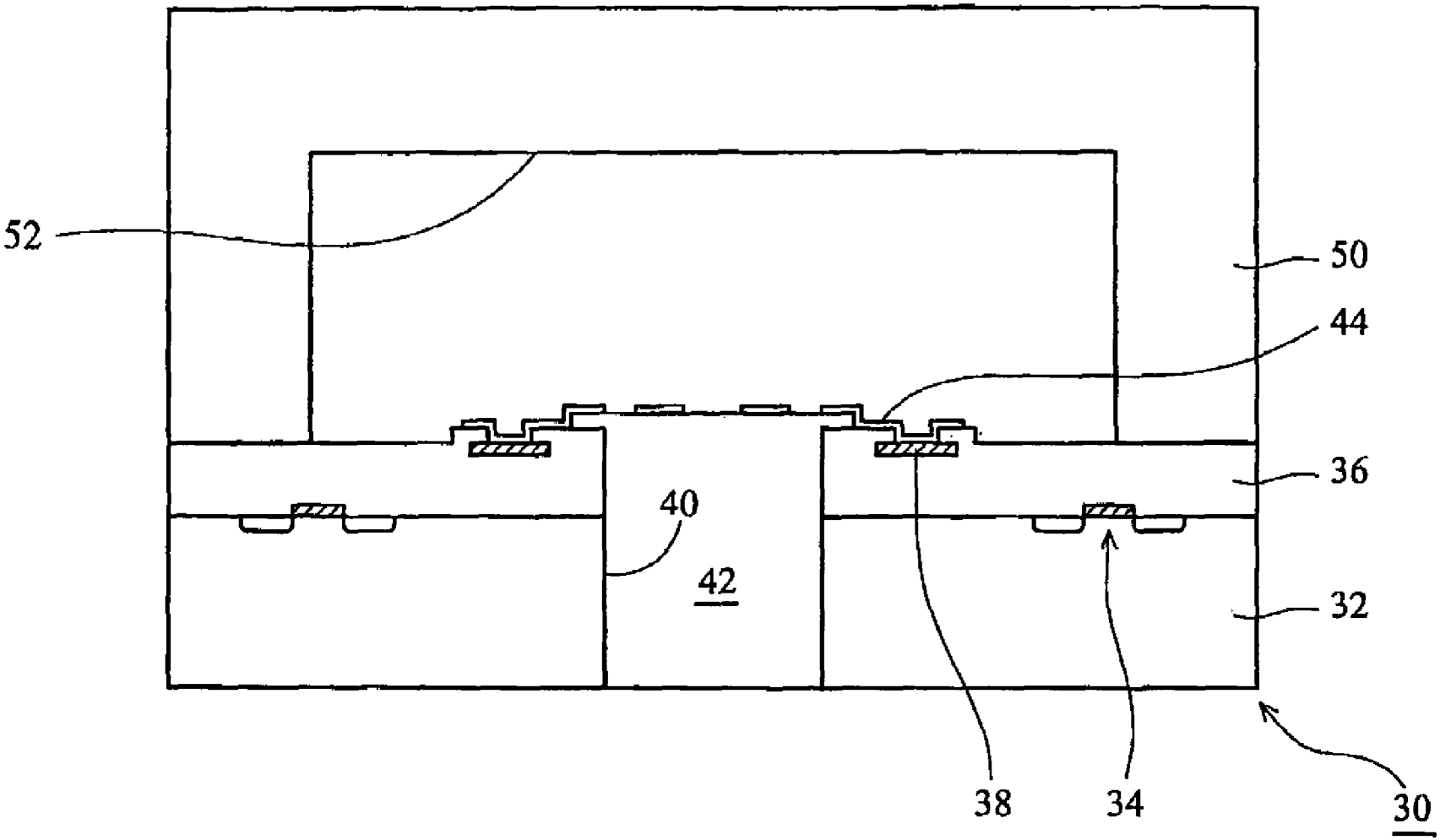

In FIG. 2G, a thinning process is performed on backsides of the provided wafer 30 and the ink-channel wafer 50 to reduce the thickness of the composite substrate. At this step, one key feature of the present invention is to thin the backside of the semiconductor substrate 32 till the sacrificial layer 42 in the ink hole 40 is exposed. The backside of the ink-channel wafer 50 is also thinned to reach a thickness of from about 100 micrometers to about 500 micrometers without breaking through the trench 52. The thinning process may include back grinding, chemical milling, CMP, wet etching or any suitable etching processes.

Figure 2H:
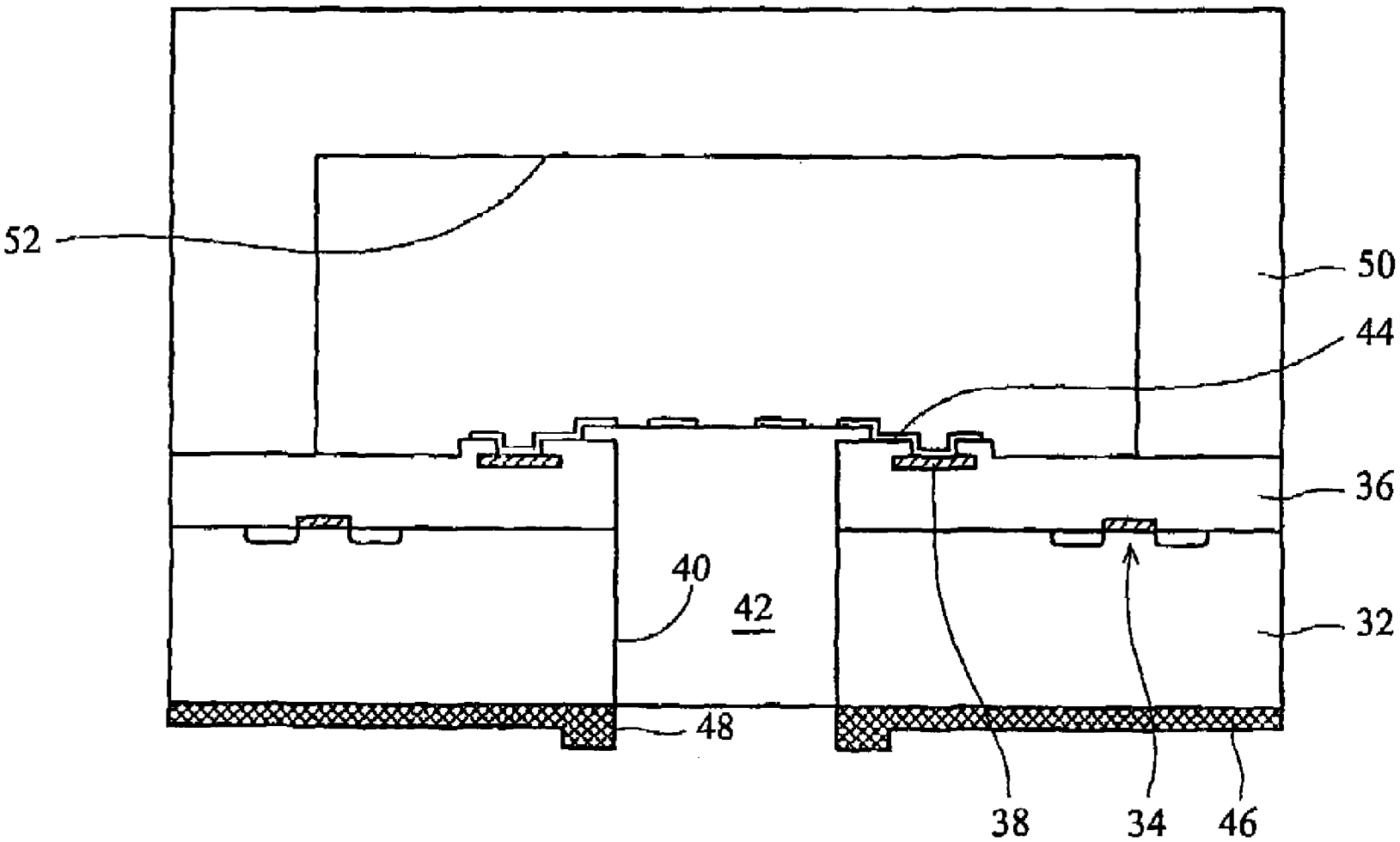

In FIG. 2H, a nozzle film 46 with at least one nozzle orifice 48 is provided on the backside of the semiconductor substrate 32 for each ink-ejection unit. The size, shape and arrangement of the nozzle orifice 48 are design choice dependent on product requirements. The nozzle orifice 48 is in a position corresponding to the ink hole 40 to allow ink ejection from the backside of the semiconductor substrate 32. For example, IC compatible processes, including CVD, photolithography and dry etch processes may be employed to pattern the nozzle film 46 with the nozzle orifice 48. The nozzle film 46 may include silicon oxide, silicon nitride, silicon oxynitride, silicon carbide, polymer, photoresist, any suitable organic material and any suitable dielectric material.

Figure 2I:
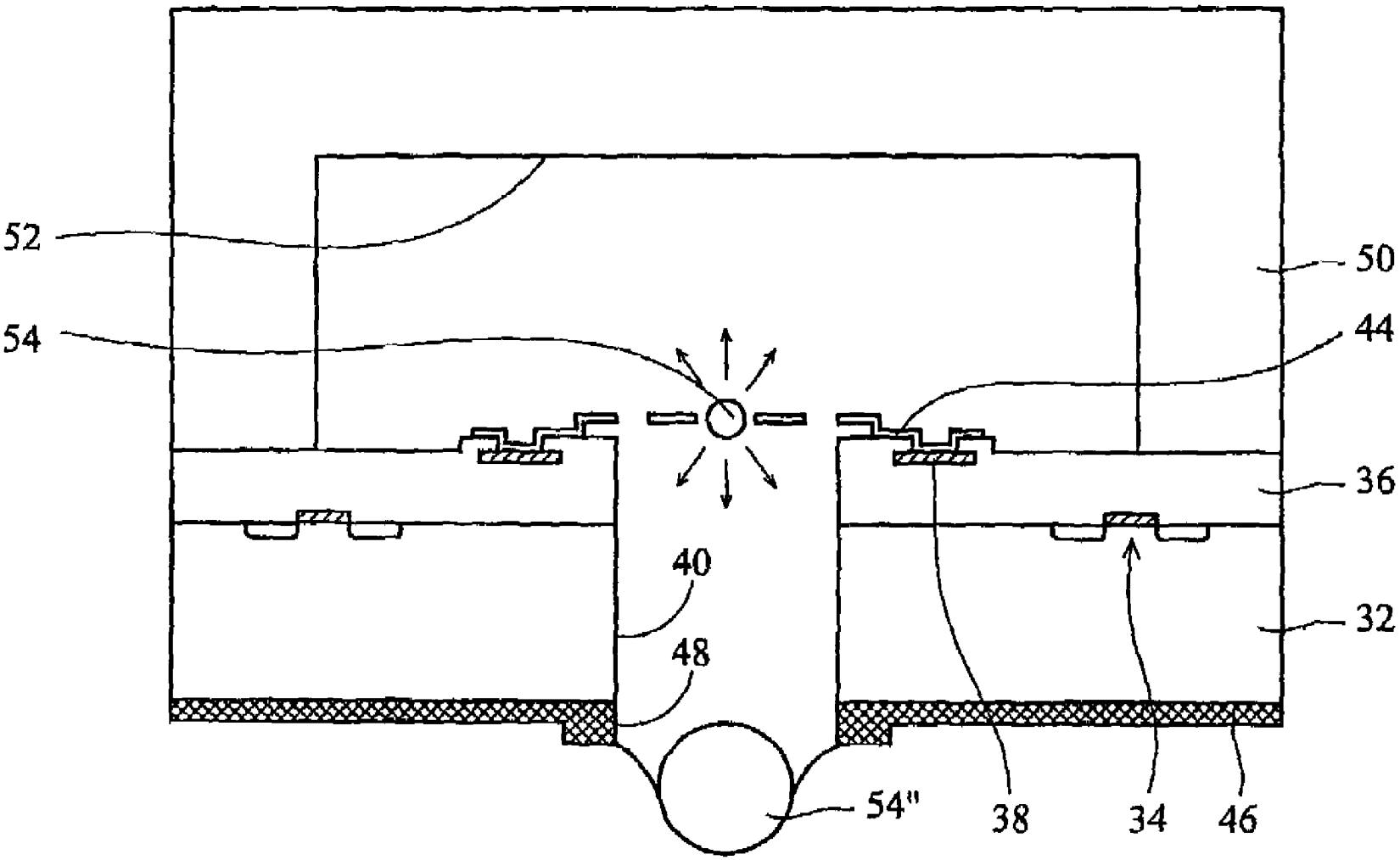

In FIG. 2I, the sacrificial layer 42 is removed from the ink hole 40 to complete the ink-ejection unit of an embodiment of the present invention. For example, developing, wet etching or dry etching procedures may be used to completely remove the sacrificial layer 42 dependent on the material characteristics of the sacrificial layer 42. Thus, the heating element 44 suspends around the exposed ink hole 40. After filling the completed printhead with ink, a bubble-jet type ink ejection mechanism is mentioned bellow. By applying pulse current to the heating element 44, ink adjacent to the heating element 44 is rapidly heated to generate a bubble 54, which grow and swell, and thus apply pressure in the ink chamber filled with the ink. As a result, an ink droplet 54" is ejected from the nozzle orifice 48. The printhead ejects ink, which may contain water, glycol and pigment particles. The printhead may also eject other suitable substances.

Accordingly, a page-width thermal inkjet printhead with an ink-channel wafer bonded to a CMOS wafer has been presented that allows two-dimensional ink ejection from the backside of the CMOS wafer and achieves the following advantages. The ink-channel wafer and the CMOS wafer are bonded together through wafer-to-wafer bonding technologies to construct a wafer-based ink-channel structure which overcomes the problems of a wafer bow effect and a fragile chamber wall of the prior art through the use of polymer-based ink-channel structure, thus being suitable for ultra-long chip applications. Compared with the conventional method for polymer-based ink-channel structure, the wafer bonding technologies for the wafer-based ink-channel structure is more simplified and IC compatible, thereby facilitating mass production. Moreover, the ink-ejection unit integrates CMOS circuits into the same silicon substrate with heater cantilevers and backside-ejecting nozzle orifices to accomplish high-density nozzles and solve the cavitation problem, thus improving printing quality and increasing usage longevity.

Figure 3:
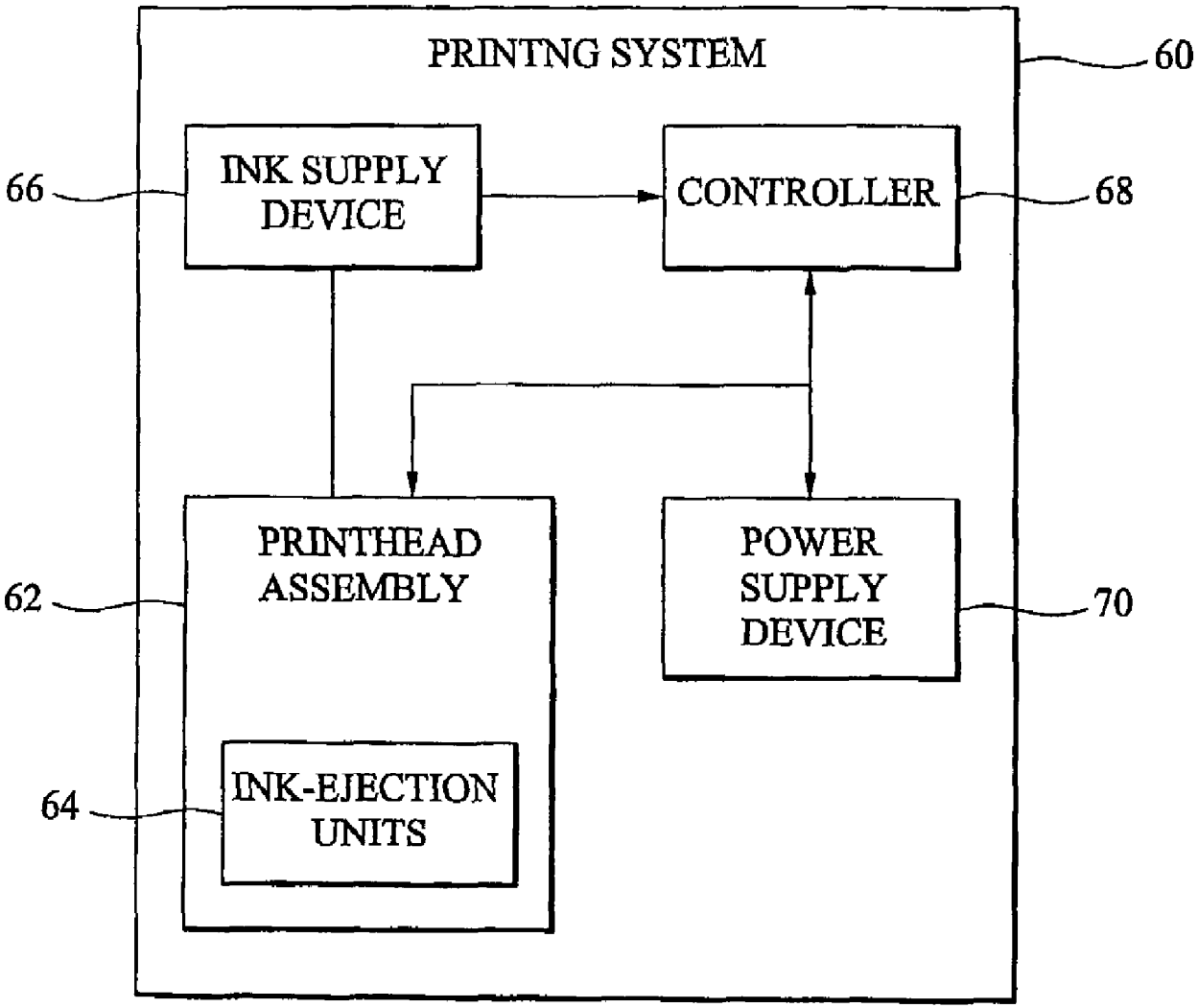
FIG. 3 is a block diagram of a printing system including an ink-ejection unit according to an embodiment of the present invention.

FIG. 3 is a block diagram of a printing system including an ink-ejection unit according to an embodiment of the present invention. An embodiment of the present invention may be applied to a printing system 60 which comprises a printhead assembly 62 with a plurality of ink-ejection units 64, an ink supply device 66, a controller 68 and a power supply device 70. The inkjet printhead with an ink-channel wafer bonded to a CMOS wafer according to the present invention is potentially suited to a wide range of printing systems including color and monochrome printers, digital printers, offset press supplemental printers, scanning printers, page-width printers, notebook computers with in-built printers, color and monochrome copiers, color and monochrome facsimile machines, large format plotters and camera printers.

Although the present invention has been described in its preferred embodiments, it is not intended to limit the invention to the precise embodiments disclosed herein. Those skilled in this technology can still make various alterations and modifications without departing from the scope and spirit of this invention. Therefore, the scope of the present invention shall be defined and protected by the following claims and their equivalents.

What is claimed is:

1. An ink-ejection unit of an inkjet printhead, comprising:

a first substrate comprising a first side and a second side opposite to said first side;

a MOS integrated circuit and a heating element formed overlying said first side of said first substrate;

a nozzle film with a nozzle orifice formed overlying said second side of said first substrate; and a second substrate with a trench bonded to said first side of said first substrate, wherein said trench is in a space surrounded by a bonding area between said first substrate and said second substrate to function as an ink channel structure, wherein said first substrate comprises at least one dielectric layer overlying said first side, in which an ink hole passes through said at least one dielectric layer and said first substrate.

2. The ink-ejection unit of an inkiet printhead of claim 1, wherein said second substrate is a silicon wafer, a silicon-containing substrate, ceramic, glass, or semiconductor material.

3. The ink-ejection unit of an inkjet printhead of claim 1, wherein said heating element is formed overlying said at least one dielectric layer to suspend around said ink hole.

4. The ink-ejection unit of an inkjet printhead of claim 1, wherein said second substrate is bonded to said at least one dielectric layer, and said trench allows an ink delivery path passing through said heating element and said ink hole.

5. The ink-ejection unit of an inkjet printhead of claim 1, wherein said nozzle orifice is in a position corresponding to said ink hole.

6. The ink-ejection unit of an inkjet printhead of claim 1, further comprising an adhesion layer on said bonding area between said first substrate and said second substrate.

7. The ink-ejection unit of an inkjet printhead of claim 1, wherein said MOS integrated circuit comprises electrical connections to drive said heating element.

8. The ink-ejection unit of an inkiet printhead of claim 1, wherein said first substrate is a silicon wafer, a semiconductor substrate, or a silicon-containing substrate.

9. The ink-ejection unit of an inkjet printhead of claim 1, wherein said nozzle film is silicon oxide, silicon nitride, silicon oxynitride, silicon carbide, dielectric material, organic material, or combinations thereof.

10. A printhead assembly comprising a plurality of ink-ejection units, and each of said plurality of ink-ejection units comprising:

a dual-wafer bonding substrate with a trench, wherein said trench is in a space surrounded by a bonding area between a first silicon wafer and a second silicon wafer to serve as an ink channel structure;

a nozzle film with a nozzle orifice formed overlying an exterior surface of said dual-wafer bonding substrate; and an adhesion layer on said bonding area between said first silicon wafer and said second silicon wafer.

11. The printhead assembly of claim 10, further comprising: a MOS integrated circuit formed overlying the inner surface of said first silicon wafer; at least one dielectric layer formed overlying said MOS integrated circuit of said first silicon wafer, wherein an ink hole passes through said at least one dielectric layer and said first silicon wafer; and a heating element formed overlying said at least one dielectric layer and suspending around said ink hole; wherein, said nozzle film is formed overlying the exterior surface of said first silicon wafer; and wherein, said nozzle orifice is in a position corresponding to said ink hole.

12. The printhead assembly of claim 11, wherein said MOS integrated circuit comprises electrical connections to drive said heating element.

13. The printhead assembly of claim 10, wherein said nozzle film is silicon oxide, silicon nitride, silicon oxynitride, silicon carbide, dielectric material, organic material, or combinations thereof.

14. A printing system, comprising:

a printhead assembly with a plurality of ink-ejection units; and a controller linked to said printhead assembly; wherein, each of said plurality of ink-ejection units comprises:

a semiconductor substrate comprising a MOS integrated circuit, a heating element and a nozzle film with a nozzle orifice; and a silicon wafer bonded to said semiconductor substrate, wherein a trench is in a space surrounded by a bonding area between said semiconductor substrate and said silicon wafer, wherein said semiconductor substrate comprises at least one dielectric layer overlying said first side, in which an ink hole passes through said at least one dielectric layer and said semiconductor substrate.

15. The printing system of claim 14, wherein said semiconductor substrate comprises: a first side and a second side opposite to said first side; wherein, said MOS integrated circuit and said heating element are formed overlying said first side of said semiconductor substrate; wherein, said nozzle film is formed overlying said second side of said semiconductor substrate; and wherein, said silicon wafer is bonded to said first side of said semiconductor substrate, and said trench allows an ink delivery path through said heating element.

16. The printing system of claim 14, wherein said heating element is formed overlying said at least one dielectric layer to suspend around said ink hole.

17. The printing system of claim 14, wherein said silicon wafer is bonded to said at least one of dielectric layer.

18. The printing system of claim 14, wherein said nozzle orifice is in a position corresponding to said ink hole.

19. The printing system of claim 14, further comprising an adhesion layer on said bonding area between said semiconductor substrate and said silicon wafer.

20. The printing system of claim 14, wherein said MOS integrated circuit comprises electrical connections to drive said heating element.

21. The printing system of claim 14, wherein said nozzle film is silicon oxide, silicon nitride, silicon oxynitride, silicon carbide, dielectric material, organic material, or combinations thereof.

* * * * *